US011082764B1

(12) United States Patent
Chen

(10) Patent No.: US 11,082,764 B1
(45) Date of Patent: Aug. 3, 2021

(54) MICROPHONE AND SPEAKER ALL-IN-ONE MACHINE

(71) Applicant: Beijing KuZhi Technology Co., Ltd., Beijing (CN)

(72) Inventor: Hua Chen, Beijing (CN)

(73) Assignee: Beijing KuZhi Technology Co., Ltd., Beijing (CN)

( * ) Notice: Subject to any disclaimer, the term of this patent is extended or adjusted under 35 U.S.C. 154(b) by 0 days.

(21) Appl. No.: 16/986,287

(22) Filed: Aug. 6, 2020

(51) Int. Cl.
*H04R 1/04* (2006.01)
*H04R 3/00* (2006.01)
*H04R 1/02* (2006.01)

(52) U.S. Cl.
CPC ..... *H04R 1/04* (2013.01); *H04R 1/026* (2013.01); *H04R 3/00* (2013.01)

(58) Field of Classification Search
CPC . H04R 1/04; H04R 1/026; H04R 3/00; G10H 1/361
See application file for complete search history.

(56) References Cited

U.S. PATENT DOCUMENTS 5,349,480 A * 9/1994 Takao ..... G10H 1/361 360/1
5,383,079 A * 1/1995 Takao ..... G11B 25/06 360/1
10,893,366 B1 * 1/2021 Yang ..... H04R 1/025
2004/0220686 A1 * 11/2004 Cass ..... G09B 23/36 700/94
2018/0332387 A1 * 11/2018 You ..... G10H 1/361
2019/0268685 A1 * 8/2019 Kawakami ..... H04R 1/08

FOREIGN PATENT DOCUMENTS

CN 209767807 U * 12/2019 ..... H04R 1/22
JP 2003108164 * 4/2003 ..... G10K 15/04

* cited by examiner

*Primary Examiner* — Andrew L Sniezek
(74) *Attorney, Agent, or Firm* — Bayramoglu Law Offices LLC

(57) ABSTRACT

A microphone and speaker all-in-one machine includes a microphone assembly, a speaker assembly and a handle assembly; the microphone assembly, the speaker assembly and the handle assembly are stacked in sequence along a same axis; the speaker assembly includes at least two horns, a speaker stand and a speaker enclosure, wherein the at least two horns are disposed symmetrically on the speaker stand, and the speaker stand is fixed in the speaker enclosure; sounding surfaces of the at least two horns are disposed at a preset angle with respect to a central axis of the speaker stand, and the sounding surfaces face away from the microphone assembly. For the microphone and speaker all-in-one machine, the output volume is increased by providing the at least two horns in the speaker assembly, and the at least two horns are disposed symmetrically.

8 Claims, 4 Drawing Sheets

MICROPHONE AND SPEAKER ALL-IN-ONE MACHINE

TECHNICAL FIELD

The invention relates to the technical field of acoustic equipment, in particular, to a microphone and speaker all-in-one machine.

BACKGROUND

With the rapid development of science and technology, in order to meet people's needs in entertainment such as live webcasting and karaoke, a variety of microphone and speaker all-in-one machines has emerged.

In the existing microphone and speaker all-in-one machine, when implementing the function of the speaker in playing sound, the output is the sound directly from the speaker, which lacks the bass sound quality; and the microphone and the speaker share the same sound cavity, which makes the sound of the microphone very easy to pick up the sound from the speaker, causing a howling problem. In order to alleviate the howling problem, the gain is usually reduced to solve. However, the reduction in gain will weaken the overall sound effect, resulting in a dull vocal sound, reducing the user experience and weakening the user's favorability.

SUMMARY

The invention provides a microphone and speaker all-in-one machine to solve the problems of poor sound quality and insufficient loudness and fullness.

The invention provides a microphone and speaker all-in-one machine. The microphone and speaker all-in-one machine includes a microphone assembly, a speaker assembly and a handle assembly;

the microphone assembly, the speaker assembly and the handle assembly are stacked in sequence along the same axis;

the speaker assembly includes at least two horns, a speaker stand and a speaker enclosure, wherein the at least two horns are disposed symmetrically on the speaker stand, and the speaker stand is fixed in the speaker enclosure;

sounding surfaces of the horns are disposed at a preset angle with respect to a central axis of the speaker stand, and the sounding surfaces face away from the microphone assembly.

Optionally, the preset angle is 15° to 30°.

Optionally, the speaker assembly further comprises at least two bass radiators, and the at least two bass radiators are disposed symmetrically on the speaker stand.

Optionally, the speaker assembly further comprises a vibration absorber pad, and the vibration absorber pad is disposed between an outer wall of the speaker stand and an inner wall of the speaker enclosure.

Optionally, the speaker stand comprises a first stand and a second stand, and the first stand is in a snap connection with the second stand.

Optionally, the microphone assembly comprises a cartridge and a sound cavity card;

the cartridge is fixed on the sound cavity card, and the sound cavity card is disposed between the speaker assembly and the cartridge.

Optionally, a surface of one side of the sound cavity card adjacent to the cartridge is provided with a cone-shaped boss, and the cartridge is mounted on one end with a smaller diameter of the boss.

Optionally, the microphone assembly further comprises a cartridge stand, the cartridge stand is disposed between the cartridge and the sound cavity card, and the cartridge stand connects the cartridge with the sound cavity card, wherein a hardness of the cartridge stand is less than a hardness of the sound cavity card.

Optionally, the microphone assembly further comprises a sound net and an anti-spray cotton;

the sound net is connected to the speaker enclosure, and the anti-spray cotton covers the sound net.

Compared with prior art, the invention has the following advantages:

In the microphone and speaker all-in-one machine provided by the embodiments of the invention, the output volume is increased by providing at least two horns in the speaker assembly, and the horns are disposed symmetrically, which can cancel out the relatively-propagated sound waves, so as to weaken the howling problem caused by the interference of the sound wave of a single horn to the cartridge; and the sounding surfaces of the horns are disposed at the preset angle with respect to the central axis of the speaker stand while the sounding surfaces facing away from the microphone assembly, which prevents the sound output by the horns from forming a positive feedback to the microphone assembly, which further helps prevent howling.

BRIEF DESCRIPTION OF THE DRAWINGS

In order to more clearly describe the technical solutions of the embodiments of the invention, the accompanying drawings required to describe the embodiments are briefly described below. Apparently, the accompanying drawings described below are only some embodiments of the invention. Those of ordinary skill in the art may further obtain other accompanying drawings based on these accompanying drawings without inventive effort.

DETAILED DESCRIPTION OF THE EMBODIMENTS

Figure 1:
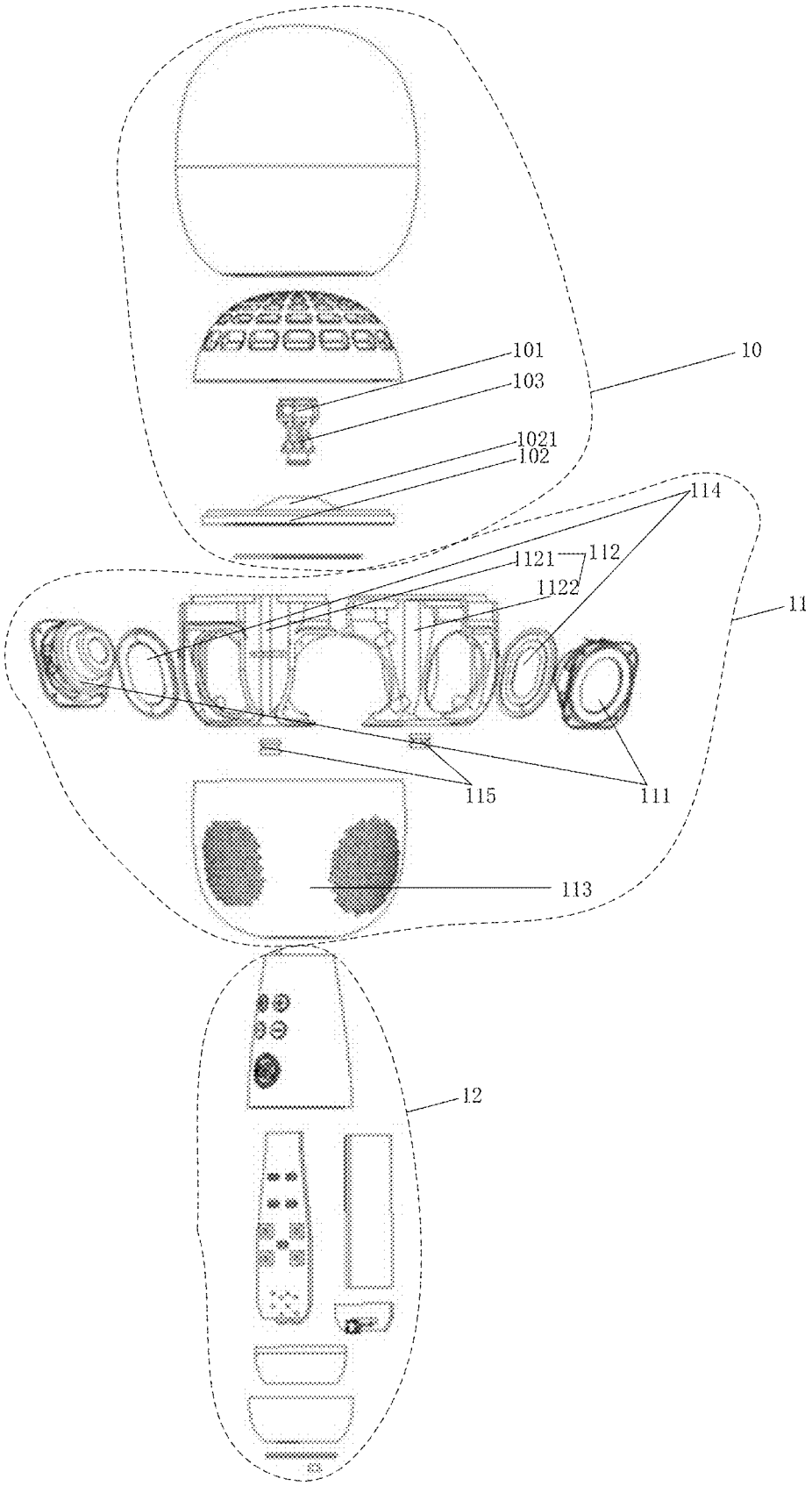
FIG. 1 is an exploded view of a microphone and speaker all-in-one machine provided by an embodiment of the invention.

To enable the above objects, features and advantages of the invention to be more apparent and easily understood, the invention will be further elaborated hereafter in connection with the drawings and specific embodiments.

With reference to FIGS. 1 to 4, the invention provides a microphone and speaker all-in-one machine. The microphone and speaker all-in-one machine includes a microphone assembly 10, a speaker assembly 11 and a handle assembly 12;

the microphone assembly 10, the speaker assembly 11 and the handle assembly 12 are stacked in sequence along the same axis;

the speaker assembly 11 includes at least two horns 111, a speaker stand 112 and a speaker enclosure 113, wherein the at least two horns 111 are disposed symmetrically on the speaker stand 112, and the speaker stand 112 is fixed in the speaker enclosure 113;

sounding surfaces M of the horns 111 are disposed at a preset angle α with respect to a central axis L of the speaker stand 112, and the sounding surfaces M face away from the microphone assembly 10.

Figure 2:
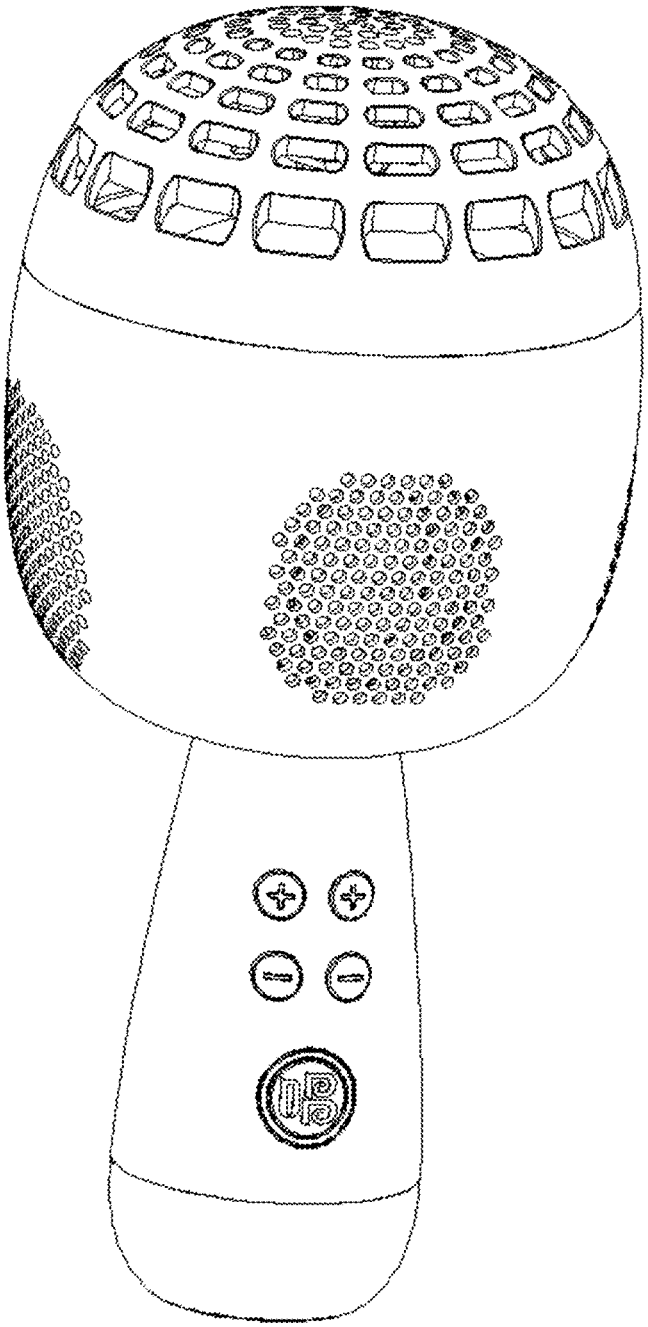
FIG. 2 is an assemble view of a microphone and speaker all-in-one machine provided by an embodiment of the invention.
Figure 3:
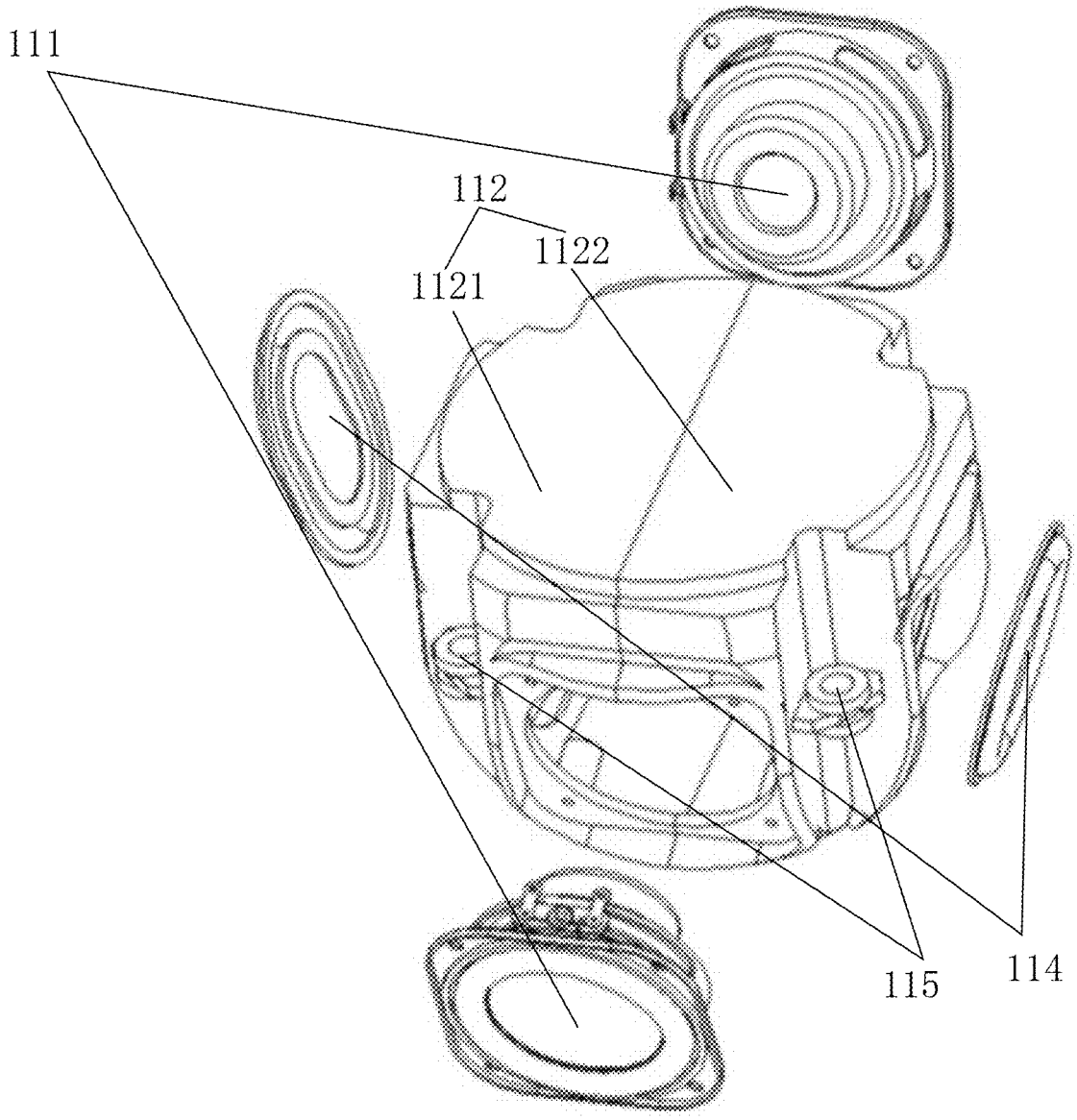
FIG. 3 is a view showing positions where horns are mounted in a microphone and speaker all-in-one machine provided by an embodiment of the invention.
Figure 4:
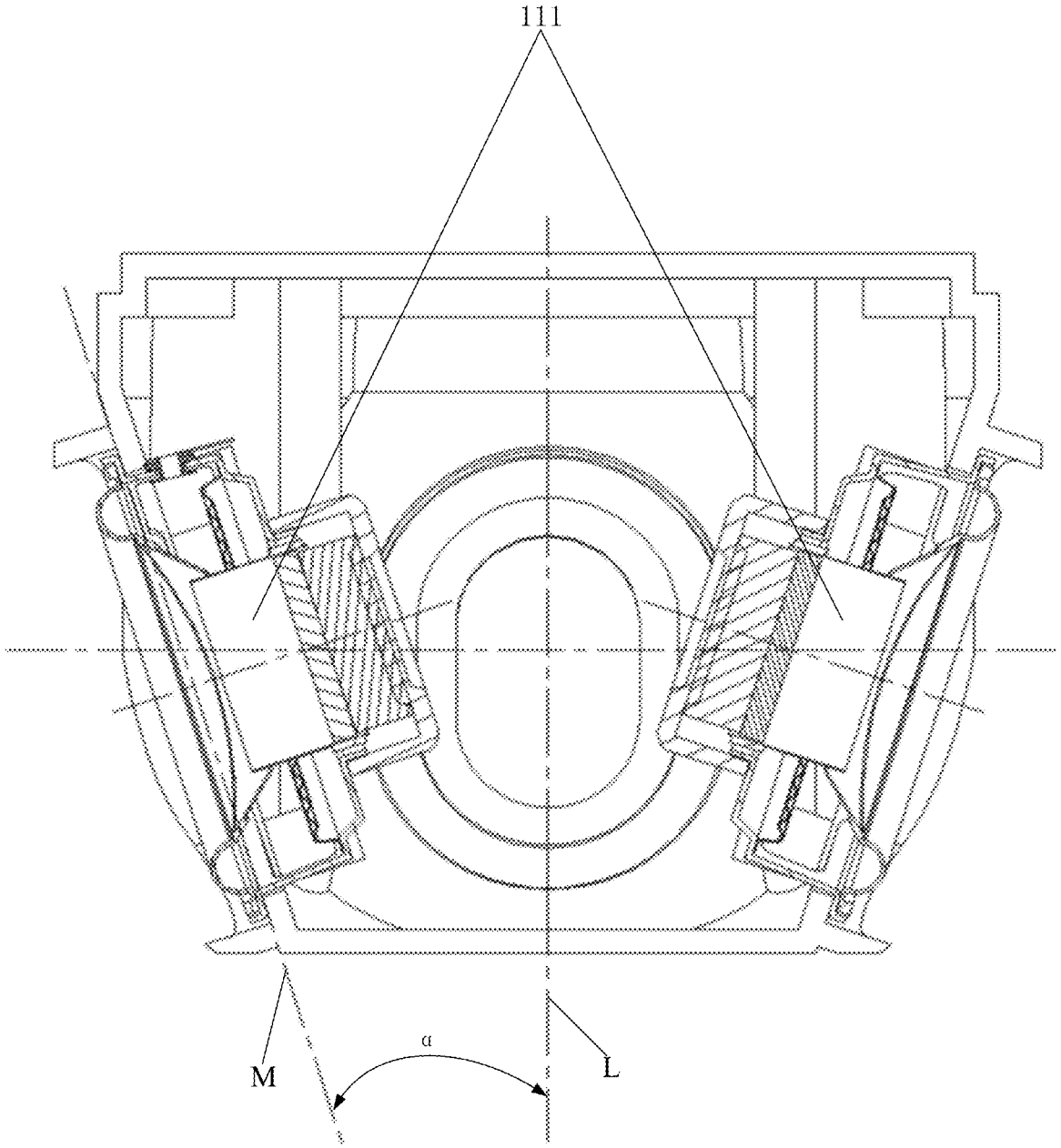
FIG. 4 is a view showing angles at which horns are mounted in a microphone and speaker all-in-one machine provided by an embodiment of the invention.

Specifically, as shown in FIG. 1, an exploded view of a microphone and speaker all-in-one machine provided by the invention is illustrated; FIG. 2 is an assemble view. The microphone and speaker all-in-one machine includes a microphone assembly 10, a speaker assembly 11 and a handle assembly 12. The microphone assembly 10 is a functional assembly for picking up sound, the speaker assembly 11 is a functional assembly for transmitting sound to the outside, and the handle assembly 12 is a holding handle of the microphone and speaker all-in-one machine and is also a mounting support for the microphone assembly 10 and the speaker assembly 11; at the same time, a control circuit may also be mounted using an inner cavity space of the handle assembly 12. The microphone assembly 10, the speaker assembly 11 and the handle assembly 12 are stacked in sequence along the same axis. That is to say, according to the upper, middle and lower structure, the microphone assembly 10 is in the upper part, the speaker assembly 11 is in the middle, and the handle assembly 12 is in the lower part. The speaker assembly 11 provided by the invention includes at least two horns 111, a speaker stand 112 and a speaker enclosure 113, wherein the at least two horns 111 are disposed symmetrically on the speaker stand 112. FIG. 3 is a view showing that two horns 111 are disposed symmetrically on the speaker stand 112, wherein horn mouths of the two horns 111 face outwards and are mounted on the speaker stand 112 in a symmetrical form of back-to-back, and the speaker stand 112 is fixed in the speaker enclosure 113. Therefore, after the sound waves emitted by each horn are reflected by the inner wall of the speaker enclosure 113, due to the symmetrical arrangement, the vibration may be reduced and the defect of howling may be improved. As shown in FIG. 4, the sounding surface M of the horn 111 is a plane where the vibration membrane is located, and the central axis L of the speaker stand 112 is an axis in which the microphone assembly 10, the speaker assembly 11 and the handle assembly 12 are stacked and mounted; the sounding surface M is disposed at a preset angle α with respect to the central axis L, the preset a being greater than zero degree, and sounding surface M faces away from the microphone assembly 10, i.e., sound propagating away from the microphone assembly 10, so that the microphone assembly 10 is prevented from picking up the sound emitted by the horn 111, which reduces positive feedback, and prevents the occurrence of howling problems.

For the microphone and speaker all-in-one machine provided by the embodiment of the invention, the output volume is increased by providing at least two horns in the speaker assembly, and the horns are disposed symmetrically, which can cancel out the relatively-propagated sound waves, so as to weaken the howling problem caused by the interference of the sound wave of a single horn to the cartridge.

Optionally, with reference to FIG. 4, the preset angle α is 15° to 30°.

Specifically, with reference to FIG. 4, when the preset angle α between the sounding surface M and the central axis L is too small, the effect of mitigating the howling problem is not significant enough; when the preset angle α between the sounding surface M and the central axis L is too large, the direction of sound propagation is too close to the position of the handle assembly 12, and the sound effect is not ideal. Therefore, considering the improvement effect and sound effect of the howling problem, the preset angle α may be set to 15° to 30°.

Optionally, with reference to FIGS. 1 and 3, the speaker assembly 11 further includes at least two bass radiators 114, and the at least two bass radiators 114 are disposed symmetrically on the speaker stand 112.

Specifically, with reference to FIGS. 1 and 3, in order to improve the bass effect of the sound emitted by the all-in-one machine, the above speaker assembly 11 further includes at least two bass radiators 114, and the at least two bass radiators 114 are symmetrically disposed on the speaker stand 112, which may also reduce vibration and improve the defects of howling.

Optionally, with reference to FIG. 1, the speaker assembly 11 further includes a vibration absorber pad 115, and the vibration absorber pad 115 is disposed between an outer wall of the speaker stand 112 and an inner wall of the speaker enclosure 113.

Specifically, as shown in FIG. 1, since the speaker stand 112 is mounted in the speaker enclosure 113, the vibration absorber pad 115 is disposed between the outer wall of the speaker stand 112 and the inner wall of the speaker enclosure 113 to buffer and reduce vibration so as to eliminate the vibration between two solids and to eliminate the howling problem as much as possible.

Optionally, with reference to FIG. 1, the speaker stand 112 includes a first stand 1121 and a second stand 1122, and the first stand 1121 is in a snap connection with the second stand 1122.

Specifically, as shown in FIG. 1, in order to facilitate the installation of the horns 111 and the bass radiator 114 on the speaker stand 112, the speaker stand 112 may be designed to include two parts of a first stand 1121 and a second stand 1122, and the first stand 1121 is in a snap connection with the second stand 1122, thereby improving the convenience in assembling and disassembling the assembly.

Optionally, with reference to FIG. 1, the microphone assembly 10 includes a cartridge 101 and a sound cavity card 102;

the cartridge 101 is fixed on the sound cavity card 102, and the sound cavity card 102 is disposed between the speaker assembly 11 and the cartridge 101.

Specifically, as shown in FIG. 1, the above microphone assembly 10 includes a cartridge 101 and a sound cavity card 102. The cartridge 101 is a component for picking up sounds, which is also called a mic. The sound cavity card 102 is a board that isolates the microphone sound cavity where the cartridge 101 is located and the speaker sound cavity where the horns 111 are located. Therefore, the cartridge 101 is fixed on the sound cavity card 102, and the sound cavity card 102 is disposed between the speaker assembly 11 and the cartridge 101, so that the microphone sound cavity and the speaker sound cavity are independently closed to avoid mutual interference of sound and reduce the risk of howling.

Optionally, with reference to FIG. 1, a surface of one side of the sound cavity card 102 adjacent to the cartridge 101 is provided with a cone-shaped boss 1021, and the cartridge 101 is mounted on one end with a smaller diameter of the boss 1021.

Specifically, as shown in FIG. 1, the surface of one side of the sound cavity card 102 adjacent to the cartridge 101 is provided with the cone-shaped boss 1021, so that the boss 1021 has a larger diameter at one end and a smaller diameter at the other end, and the cartridge 101 is mounted at the end with a smaller diameter of the boss 1021, and the end with the larger diameter is connected to the sound cavity card 102. Of course, in actual applications, the sound cavity card 102 and the boss 1021 may also be injection molded into one body through the injection molding process. The boss 1021 forms an approximately cone-shaped convex structure on the sound cavity card 102, thereby changing the acoustic structure of the microphone sound cavity, which is more conducive to preventing the problem of microphone spraying.

Optionally, with reference to FIG. 1, the microphone assembly 10 further includes a cartridge stand 103, the cartridge stand 103 is disposed between the cartridge 101 and the sound cavity card 102, and the cartridge stand 103 connects the cartridge 101 with the sound cavity card 102, wherein a hardness of the cartridge stand 103 is less than a hardness of the sound cavity card 102.

Specifically, as shown in FIG. 1, the microphone assembly 10 further includes a cartridge stand 103, the cartridge stand 103 is disposed between the cartridge 101 and the sound cavity card 102, and the cartridge stand 103 connects the cartridge 101 with the sound cavity card 102, wherein in order to attenuate the vibration from the sound cavity card 102, a hardness of the cartridge stand 103 is less than a hardness of the sound cavity card 102. The cartridge stand 103 may be made of any one of plastic, rubber, and silicone, that is, the cartridge stand 103 may be made of soft materials.

Optionally, the microphone assembly 10 further includes a sound net and an anti-spray cotton;

the sound net is connected to the speaker enclosure 113, and the anti-spray cotton covers the sound net.

Specifically, the above microphone assembly 10 further includes a sound net and an anti-spray cotton; the sound net is connected to the speaker enclosure 113, and the anti-spray cotton covers the sound net. The sound net may be a plastic sound net, a single layer or double layer sound net made of metal. Through the sound net and anti-spray cotton, the noise and saliva may be filtered with physical modification, thereby improving the sound pick-up quality.

In the microphone and speaker all-in-one machine provided by the embodiment of the invention, the output volume is increased by providing at least two horns in the speaker assembly, and the horns are disposed symmetrically, which can cancel out the relatively-propagated sound waves, so as to weaken the howling problem caused by the interference of the sound wave of a single horn to the cartridge; moreover, the angle set for the horns also helps to improve the defects of howling, and at least two bass radiators also improve the bass effect. In summary, the microphone and speaker all-in-one machine provided by the embodiment of the invention has lower risk of howling, and an excellent output sound quality effect.

What is mentioned above is only the specific implementation manner of the invention, but does not limit the protection scope of the invention, and anyone skilled in the art may easily think of mortifications and alternations within the technical scope disclosed by the invention, all of which should be contained within the protection scope of the invention. Therefore, the scope of the invention should be determined by the scope of the claims.

It should be noted that those skilled in the art may make some improvements and modifications without departing from the principle of the invention. These improvements and modifications should also be regarded as the scope of protection of the invention.

At the end, it is to be explained that the relationship terms, such as "first" and "second", are used herein only for distinguishing one entity or operation from another entity or operation but do not necessarily require or imply that there exists any actual relationship or sequence of this sort between these entities or operations. Furthermore, terms "comprising", "including" or any other variants are intended to cover the non-exclusive including, thereby making that the process, method, merchandise or terminal device comprising a series of elements comprise not only those elements but also other elements that are not listed explicitly or the inherent elements to the process, method, merchandise or device. In the case of no more limitations, the element limited by the sentence "comprising a . . . " does not exclude that there exists another same element in the process, method, merchandise or terminal device comprising the element.

Therein before, a microphone and speaker all-in-one machine provided by the invention are introduced in detail and the principle and execution mode of the invention are illustrated by applying particular examples while the above embodiments are illustrated only for aiding in understanding the method and the core concept thereof of the invention; meanwhile, modifications may be made in the specific execution mode and application scope by those skilled in the art according to the concept of the invention. To sum up, the content of the specification should not be understood as limiting the invention.

What is claimed is:

1. A microphone and speaker all-in-one machine, comprising a microphone assembly, a speaker assembly and a handle assembly; wherein the microphone assembly, the speaker assembly and the handle assembly are stacked in a sequence along an axis;

the speaker assembly comprises at least two horns, a speaker stand and a speaker enclosure, wherein the at least two horns are disposed symmetrically on the speaker stand, and the speaker stand is fixed in the speaker enclosure;

a plurality of sounding surfaces of the at least two horns are disposed at a preset angle of between 15° to 30° with respect to a central axis of the speaker stand, and the plurality of sounding surfaces face away from the microphone assembly.

2. The microphone and speaker all-in-one machine according to claim 1, wherein the speaker assembly further comprises at least two bass radiators, and the at least two bass radiators are disposed symmetrically on the speaker stand and substantially perpendicular to the at least two horns.

3. The microphone and speaker all-in-one machine according to claim 1, wherein the speaker assembly further comprises a vibration absorber pad, and the vibration absorber pad is disposed between an outer wall of the speaker stand and an inner wall of the speaker enclosure.

4. The microphone and speaker all-in-one machine according to claim 1, wherein the speaker stand comprises a first stand and a second stand, and the first stand is in a snap connection with the second stand.

5. The microphone and speaker all-in-one machine according to claim 1, wherein the microphone assembly comprises a cartridge and a sound cavity card;

the cartridge is fixed on the sound cavity card, and the sound cavity card is disposed between the speaker assembly and the cartridge.

6. The microphone and speaker all-in-one machine according to claim 5, wherein a surface of one side of the sound cavity card adjacent to the cartridge is provided with a cone-shaped boss, and the cartridge is mounted on one end with a smaller diameter of the cone-shaped boss.

7. The microphone and speaker all-in-one machine according to claim 5, wherein the microphone assembly further comprises a cartridge stand, the cartridge stand is disposed between the cartridge and the sound cavity card, and the cartridge stand connects the cartridge with the sound cavity card, wherein a hardness of the cartridge stand is less than a hardness of the sound cavity card.

8. The microphone and speaker all-in-one machine according to claim 1, wherein the microphone assembly further comprises a sound net and an anti-spray cotton;

the sound net is connected to the speaker enclosure, and the anti-spray cotton covers the sound net.

* * * * *